US006520240B2

(12) United States Patent
Sooklaris

(10) Patent No.: US 6,520,240 B2
(45) Date of Patent: Feb. 18, 2003

(54) BRACING SYSTEM FOR CANVAS STRETCHER FRAMES

(76) Inventor: John M. Sooklaris, 128 Lakeside Dr., Corte Madera, CA (US) 94925

( * ) Notice: Subject to any disclaimer, the term of this patent is extended or adjusted under 35 U.S.C. 154(b) by 0 days.

(21) Appl. No.: 09/828,320

(22) Filed: Apr. 5, 2001

(65) Prior Publication Data

US 2002/0014316 A1 Feb. 7, 2002

Related U.S. Application Data

(60) Provisional application No. 60/195,592, filed on Apr. 6, 2000.

(51) Int. Cl.[7] ..... D06C 3/08

(52) U.S. Cl. ..... 160/379; 160/374.1

(58) Field of Search ..... 160/379, 374.1, 160/377, 378, 381; 38/102.1, 102.3, 102.4, 102.5, 102.9; 40/739, 741, 742; 403/295, 402

(56) References Cited

U.S. PATENT DOCUMENTS

| | | | | | |
|---|---|---|---|---|---|
| 1,128,362 | A | * | 2/1915 | Rawbon | 160/374.1 |
| 1,325,519 | A | * | 12/1919 | Jenkins | 160/374.1 |
| 1,824,187 | A | * | 9/1931 | Adams | 160/374.1 |
| 3,012,362 | A | * | 12/1961 | Blinderman | 160/374.1 |
| 3,830,278 | A | * | 8/1974 | Packer | 160/378 |
| 3,882,616 | A | * | 5/1975 | Starzyk | 160/374.1 X |
| 6,127,019 | A | * | 10/2000 | Means | 160/379 |
| 6,253,471 | B1 | * | 7/2001 | Strauh | 160/381 |

* cited by examiner

*Primary Examiner*—David M. Purol
(74) *Attorney, Agent, or Firm*—Thomas M. Freiburger

(57) ABSTRACT

A bracing system for canvas stretcher frames allows for positioning of one or more braces in a stretcher bar frame, to prevent inward pulling of the stretcher bars under canvas tension. The braces are modular in design and allow convenient assembly of multiple-braced stretcher bar frames. The braces have tenons which engage with a groove extending around the inner periphery of the stretcher bar frame, and the braces themselves preferably have grooves in their edges, to receive the tenons of further braces.

12 Claims, 7 Drawing Sheets

10
12
14
24
14
12

10b
24

24a

24a 26
24a
26

12
26
24a
26
12

26g
24g
26g 24i
26i
26i

48

48a

30

30
24

48a

BRACING SYSTEM FOR CANVAS STRETCHER FRAMES

REFERENCE TO PROVISIONAL APPLICATION

This application claims the benefit of provisional application Ser. No. 60/195,592, filed Apr. 6, 2000.

BACKGROUND OF THE INVENTION

This invention concerns canvas stretching frames, and particularly a bracing system for relatively large canvases, to prevent pulling inward of the peripheral stretcher bars due to tension.

Canvas stretcher frames have previously used bracing for large canvases. However, these were limited by several factors. The braces, typically in a cross or X configuration in the frame, comprising a pair of brace bars orthogonally arranged relative to the peripheral stretcher bars, usually crossed over one another with routed out sections of each brace, in a manner such that the two crossing braces lay in the same plane. Where the ends of the braces met the stretcher bars, typically each brace had a protruding tongue or tenon at its end, which was received in a routed out recess or mortise in the stretcher bar at that location, dedicated to that purpose.

In conventional stretcher bar bracing systems there was no specific provision for addition of further braces beyond the two crossing braces described. In very large canvases further bracing is often needed, requiring custom-made additional braces, further routing out of components to receive bracing, etc.

SUMMARY OF THE INVENTION

The present invention provides a relatively simple and easily used bracing system for large canvas frames, wherein the bracing bars are modular in nature and can be added as needed, and wherein braces do not cross over one another.

The peripheral stretcher bars in the system of the invention each have a groove formed on the inner side, so as to face inwardly toward the interior of the space behind the canvas. These grooves are employed to receive bracing bars wherever needed, and in as great a number as needed, and these can include angled braces. Thus, at the back of a canvas frame of the invention, a contiguous groove runs completely around the inner periphery of the frame.

The braces useful for these canvas frames are relatively simple bars, but with tabs or tongues at their ends, insertable into the grooves of the stretcher bars which make up the canvas frame. In the invention, in one typical application, a single brace will extend through the entire length or width of the stretcher bar frame. The remaining bracing is accomplished between that brace, typically centrally located, and the peripheral stretcher bars which are parallel to that single brace, these additional braces being perpendicular to the center brace. In other applications, two or three or four full-length braces can be assembled to retain stretcher bars from pulling inwardly in a long dimension of a large canvas. Then, shorter sections of brace can be inserted in the perpendicular direction, completing the bracing of the entire frame. To receive the additional bracing, the braces themselves have grooves along their side edges, and these grooves receive the tabs or tongues of the additional, smaller braces that are inserted as described above.

In a variation of the above, the bracing can be accomplished with a series of braces all of which are shorter than the full dimension between parallel stretcher bars. A pattern or matrix of the shorter braces can be put together, if desired, all fitting together with the tab and groove connections, so as to build a bracing system that retains all four frame stretcher bars from pulling inward under tension, without any single brace extending from bar to bar.

By this modular set of components, the bracing of a large canvas is made much more efficient, the bracing system can be made stronger, and the modularity of the components allows a framing shop to build a multiplicity of different sizes of fully braced frames from stretcher bars and standard brace components held in inventory, or a customer can purchase components to build a braced frame as needed. This is in contrast with the conventional situation in which a large frame often has to be custom built, with custom-formed bracing.

It is thus among the objects of the invention to improve the construction of braced canvas frames, and to modularize a bracing system so as to allow braced frames to be put together in a modular manner without custom-made components. These and other objects, advantages and features of the invention will be apparent from the following description of a preferred embodiment, considered along with the accompanying drawings.

DESCRIPTION OF PREFERRED EMBODIMENTS

Figure 1:
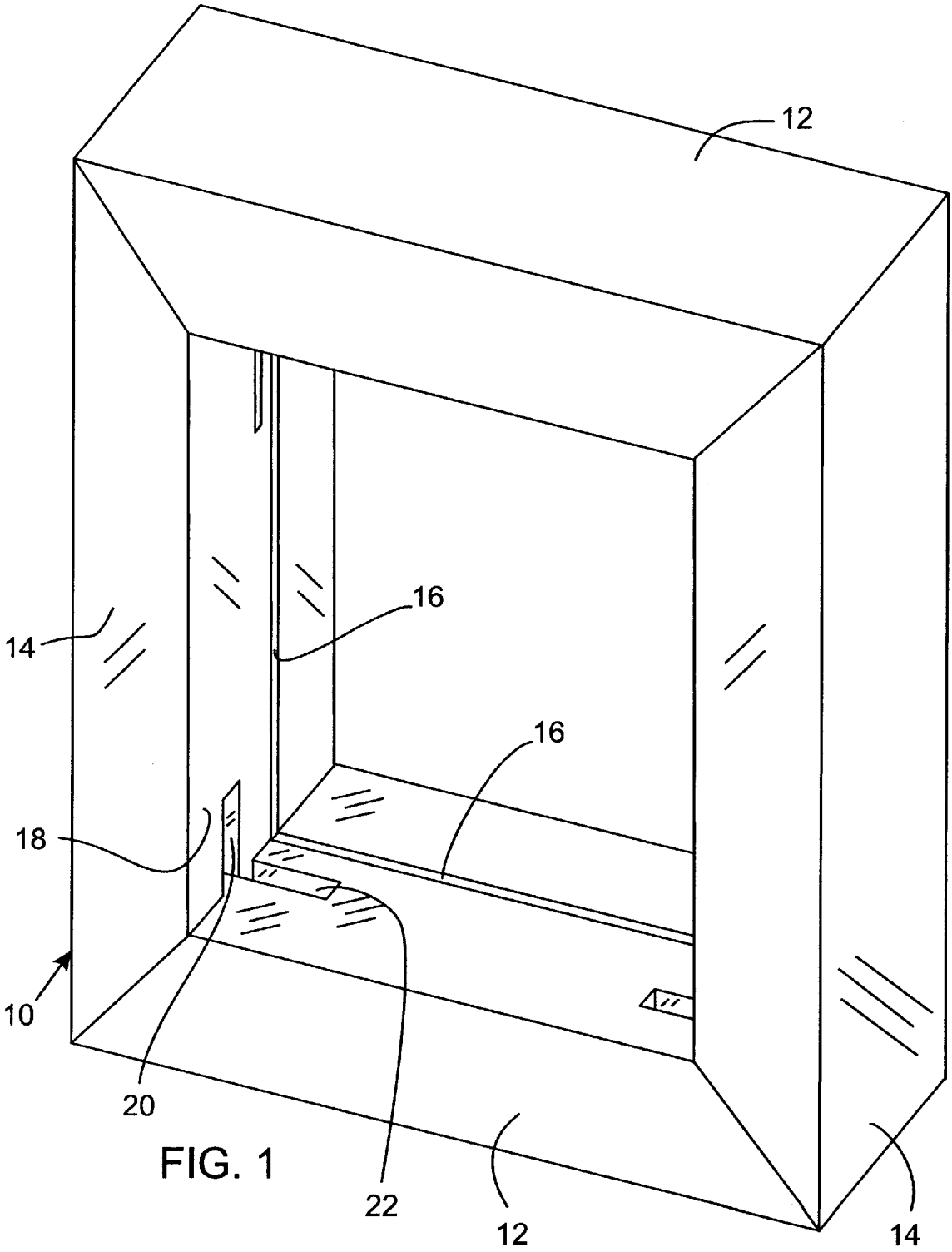
FIG. 1 is a perspective view showing a canvas frame having a groove on the inner side of the stretcher bars in accordance with the invention.

FIG. 1 shows in perspective and somewhat schematically a stretcher bar frame 10 for receiving a canvas. FIG. 1 is only for purposes of illustration; the frames with which the invention is concerned are generally of somewhat different proportion, with at least one dimension which is quite long so as to require bracing to prevent the stretcher bars 12 and 14 from pulling inwardly under the tension of a stretched canvas.

FIG. 1 shows a groove 16 which is provided in each stretcher bar, on the inner surface such that it faces inwardly in the completed stretcher bar frame 10, forming a contiguous groove around the inner periphery of the frame. Preferably this groove 16 is located off center on the inner surface 18 of each stretcher bar, either toward the canvas at the front of the frame or toward the back of the frame. This is to accompany a preferred embodiment of the invention which will be described below.

FIG. 1 also shows recesses 20 and 22 which are portions of mortises, of the mortis-and-tenon joinery preferably used at the mitered edges of the stretcher bars of the frame.

Figures 2A, 2B, 2C, 2D, 2E, 2F, 2G, 2H, 2I, 2J, 2K, 2L, 2M, 2N, 2O, 2P, 2Q, 2R, 2S, 2T:
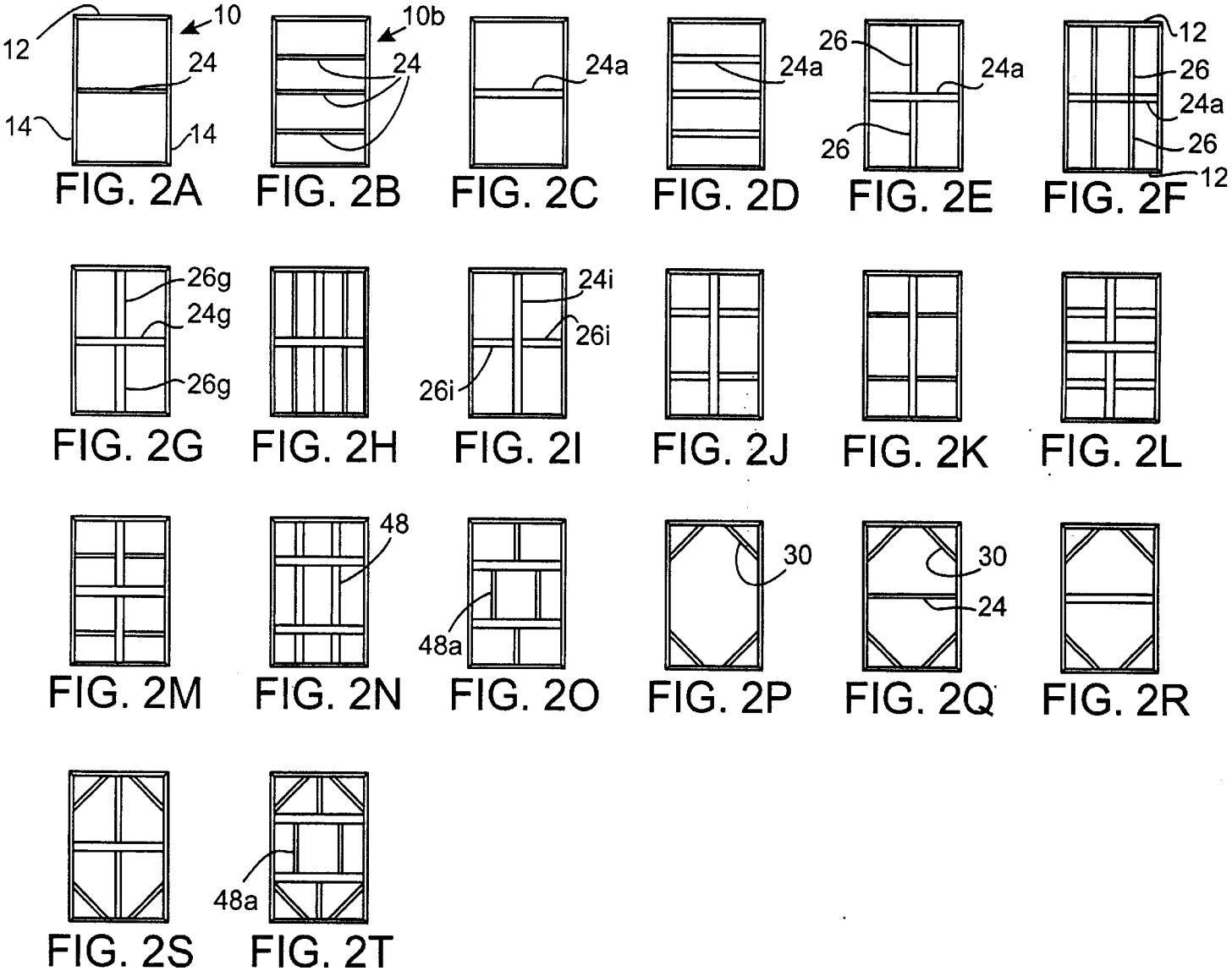
FIGS. 2A through 2T show various bracing configurations built from the system of the invention.

FIGS. 2A through 2T show various configuration of bracing according to the system of the invention, with the bracing in different patterns on frames, for purpose of example, that have essentially the same proportions. FIG. 2A, for example, shows a stretcher bar frame 10 having side and end stretcher bars 12 and 14, and having a single, simple brace 24 spanning across the shorter dimension, so as to maintain separation between the longer stretcher bars 14 under conditions of canvas tension.

FIG. 2B shows a similar frame 10*b* with three simple braces 24 supporting the longer stretcher bars against pulling inwardly.

FIGS. 2C and 2D are similar to FIGS. 2A and 2B but show that the simple braces 24*a* can be of greater width when needed.

FIGS. 2E and 2F show the use of a simple brace 24*a* crossing the narrow dimension of a frame, while braces 26 in the perpendicular direction are provided for bracing the end stretcher bars 14. The braces 26, which can be called cross braces, do not extend the full length between the end stretcher bar 12 but extend from a stretcher bar to the simple brace 24*a*.

FIGS. 2G and 2I are included to show that the simple brace 24*g* or 24*i* can either be positioned in the horizontal direction or the vertical direction, with the cross braces 26*g* or 26*i* being perpendicular. In each of these drawings, the braces are shown with continuous lines for the brace is continuous, and cross braces are shown abutting against the continuous braces.

FIGS. 2P through 2T show diamond braces or angled braces 30 near corners of the stretcher bar frames. These can be used alone, as in FIG. 2P, or in combination with other bracing as in the other drawings. FIG. 2Q shows four diamond braces 30 and a simple brace 24 extending across the narrower dimension of the frame, as does FIG. 2R. FIGS. 2S and 2T show other patterns.

Figure 3:
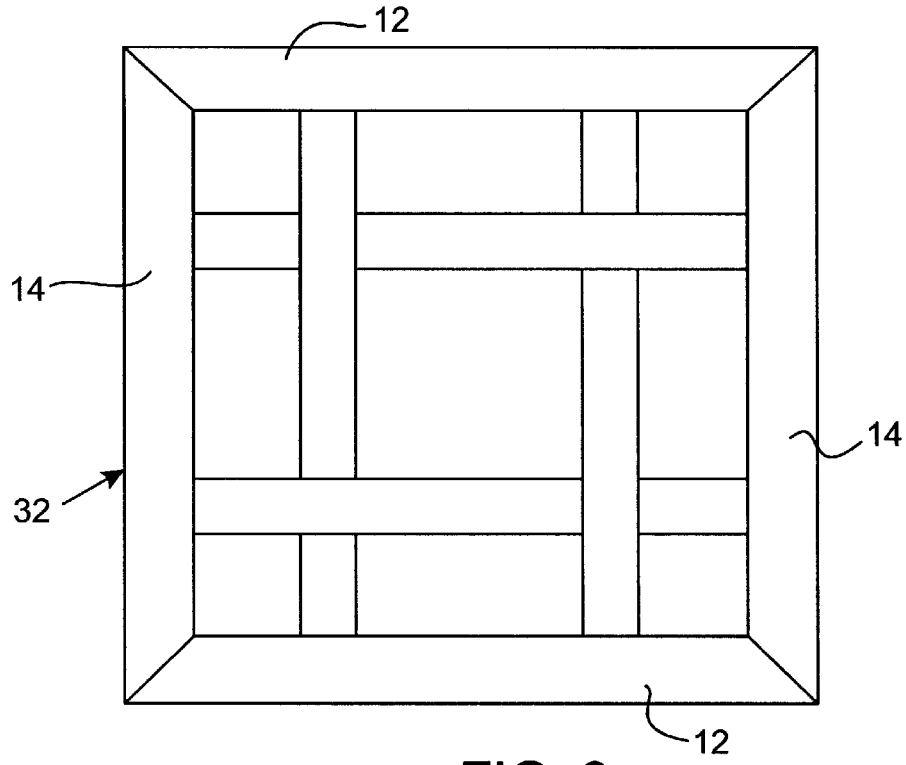
FIG. 3 is a schematic view showing another arrangement of bracing.

FIG. 3 shows another exemplary frame pattern wherein a stretcher bar frame 32 has a set of braces none of which is a "simple" brace extending the entire length between parallel stretcher bars. This differs from the arrangements shown in the Figures above.

Figure 4:
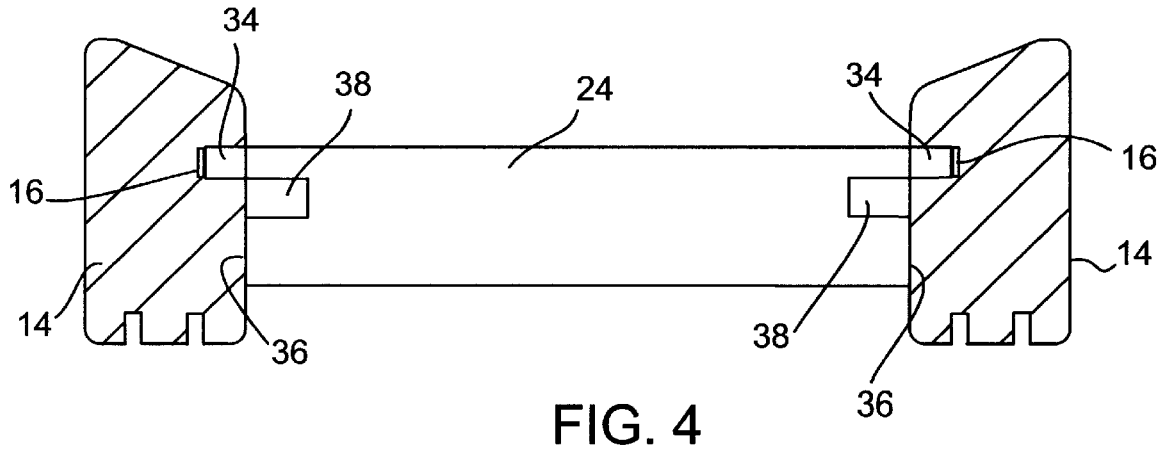
FIG. 4 is a simplified cross-sectional view, showing a single brace engaged between two stretcher bars.
Figure 5:
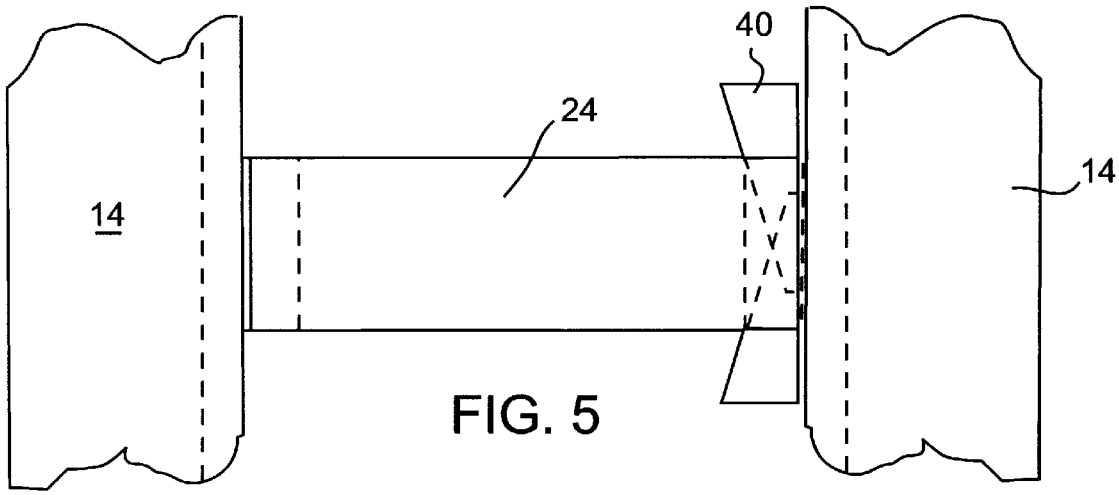
FIG. 5 is a fragmentary view showing wedge-shaped keys which can be used to secure a brace to a stretcher bar, and which can be used to hold the frame in an expanded configuration when the frame has been expanded to re-tension a canvas.

FIG. 4 shows one preferred arrangement for attachment of the braces to the stretcher bars. A simple brace 24 is shown extending between two parallel stretcher bars 14, the stretcher bars being shown in cross section. The stretcher bar grooves are shown at 16. The grooves receive a tenon 34 which extends from each end of the simple brace 24. FIG. 4 illustrates the reason why the stretcher bar groove 16 is located either toward the front of the frame or back of the frame, rather than centrally located along the width of the stretcher bar. The tenons 34 preferably are at one edge of the brace 24 as shown. The brace has an adjacent end 36 which does not protrude as does the tenon, and which abuts against the face of the stretcher bar 14 as shown. Between the end 36 and the tenon 34 is preferably included a groove 38, which is known from previous canvas frame braces. The groove 38 allows a wedge-shaped key 40 to be tapped in with a hammer when the frame needs to be expanded for re-tensioning the canvas.

Figure 8:
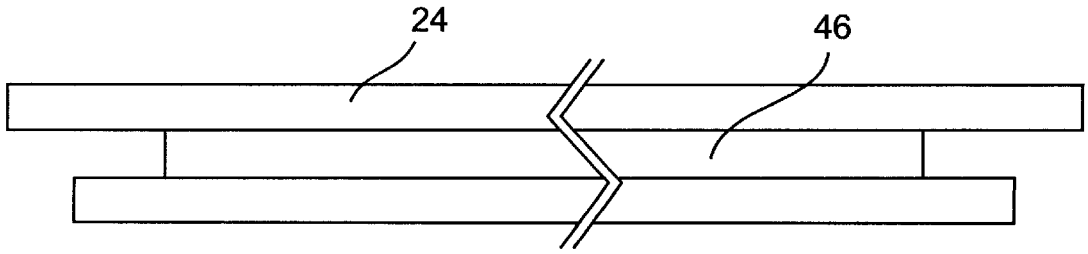
FIG. 8 is a side view showing one form of brace of the system, used for extending from one stretcher bar to the opposite stretcher bar.

FIG. 8 shows the simple brace of FIG. 4. The narrow dimension of the brace is shown, and as noted above, the wide dimension can be in several different widths if desired, as illustrated in FIGS. 2A–2T.

Figure 9:
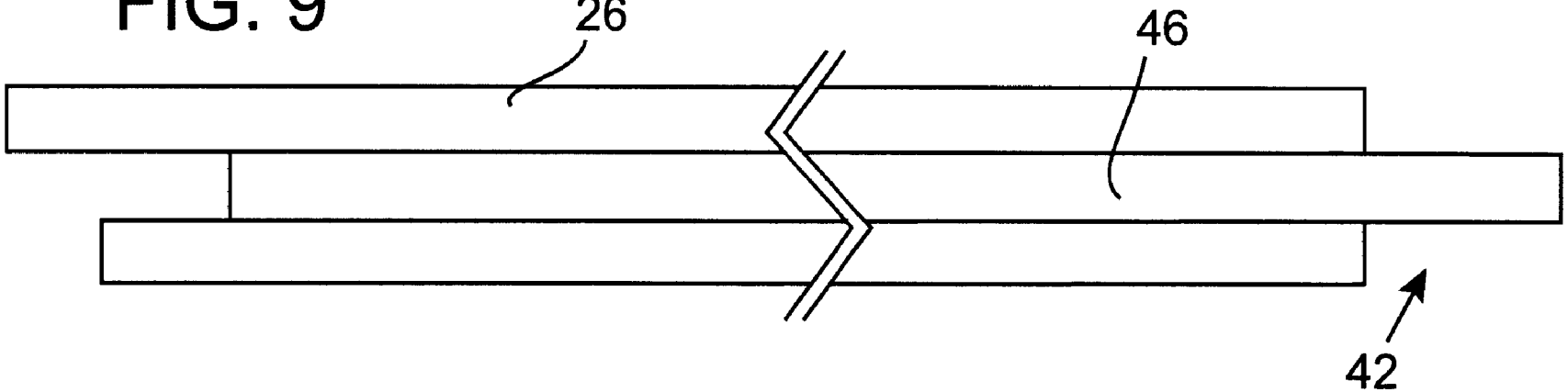
FIG. 9 is a view showing a different form of brace, for extending from a stretcher bar to another brace.

FIG. 9 shows a different brace 26, which can be called a cross brace as noted above. This brace is similar to the simple brace 24, but it is not intended the full length from stretcher bar to stretcher bar, and thus has a different second end 42. The second end 42 has a tenon 44 at its center, designed to engage with a groove in another brace. The groove is shown, for example, at 46 in the cross brace 26 of FIG. 9, and it should be assumed that all braces shown herein can have such grooves, although certain braces dedicated to not receiving any further bracing can be formed without the grooves. This groove 46 is also shown in FIG. 8.

Figure 10:
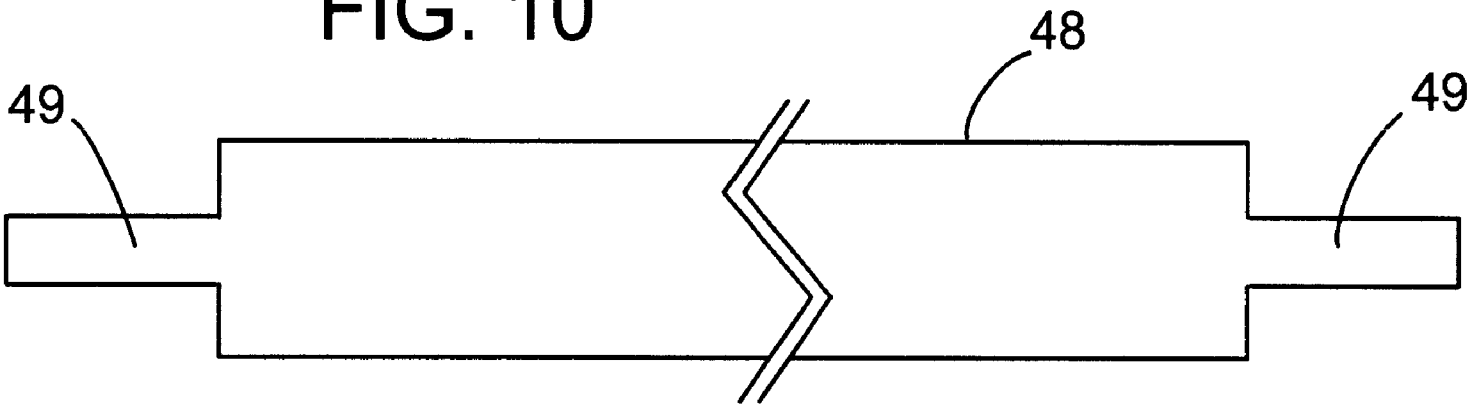
FIG. 10 is another view similar to FIGS. 8 and 9, showing in edge view a brace which extends between two braces.

FIG. 10 shows a further type of brace 48, which can be called a middle brace. Such a brace would be at a position such as shown at 48 or 48*a* in FIGS. 2N and 2O, for example, or at 48*a* in FIG. 2T. Neither end of the middle brace 48 engages against a stretcher bar, but the brace merely extends between two parallel braces. Again, these braces may or may not have grooves for receiving further braces.

Figure 6:
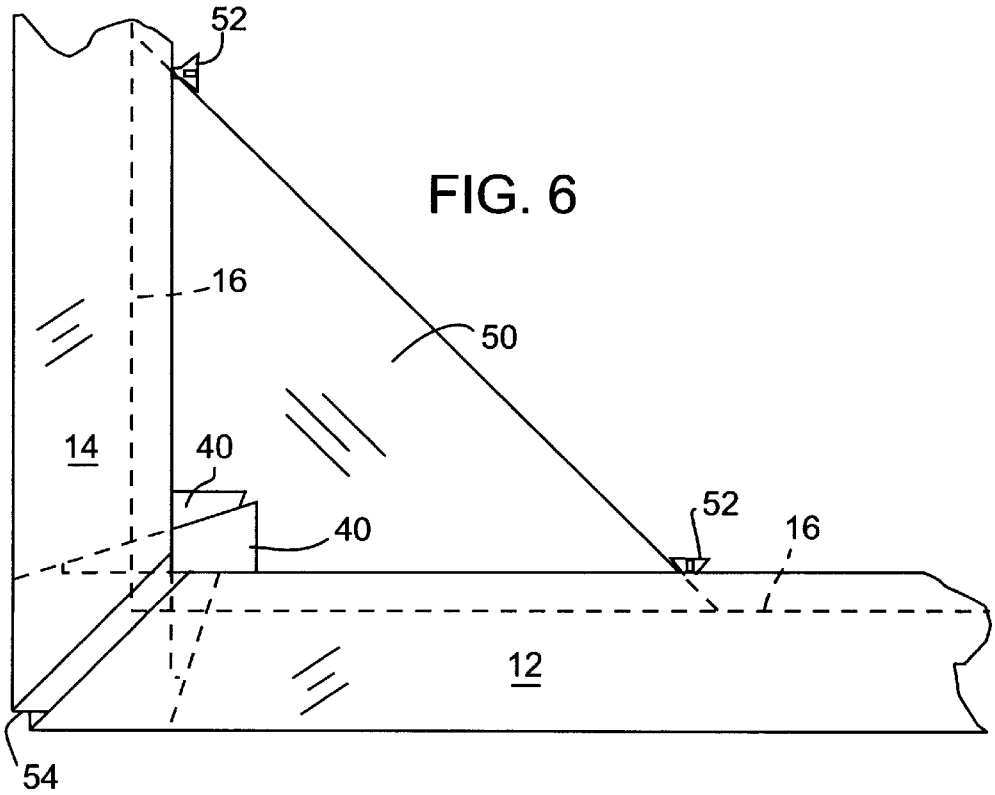
FIG. 6 is a fragmentary view showing use of a corner support at a stretcher bar frame corner.

FIG. 6 shows a corner support 50 which can be used with frames according to the invention. The corner support 50, which can be formed with hardboard, extends into the groove 16 of both the stretcher bars 14 and 16 at the corner formed between them, and screws 52 can be used to lock this corner support in position. This illustrates another useful purpose of the groove 16, which extends around the inner periphery of the stretcher bar frame. FIG. 6 also-shows keys or wedges 40 which can be used to lock the frame size once the frame has been expanded (as shown at 54, for example) to re-tension a canvas. These wedges are jammed not into the groove 16 but into mortises which a part of mortis-and-tenon joinery at the mitered corners of the frame, as further explained below.

Figure 7:
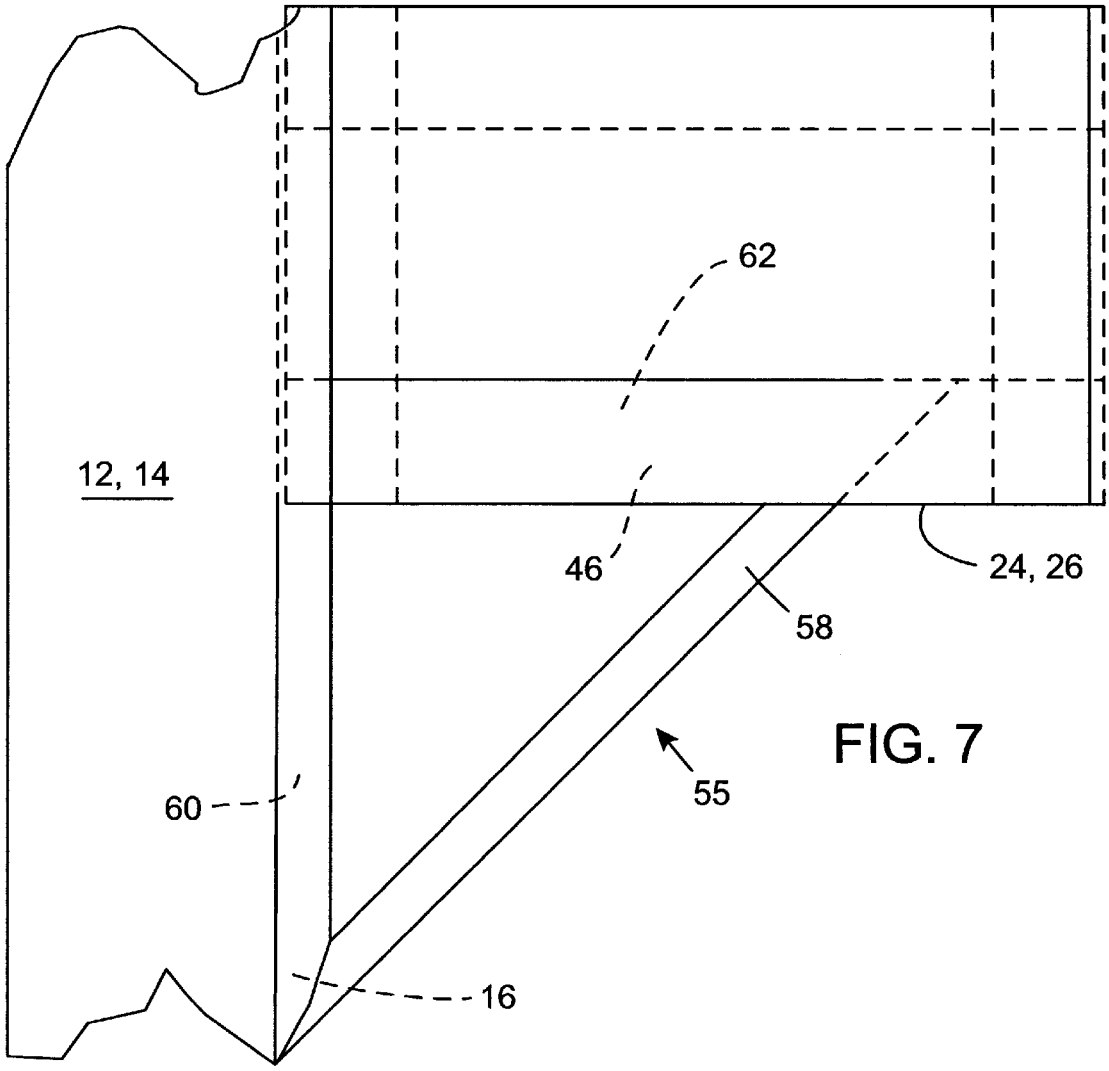
FIG. 7 is a fragmentary view showing a tenoned corner support or angle brace as used at the joint between a brace and a stretcher bar.
Figure 11:
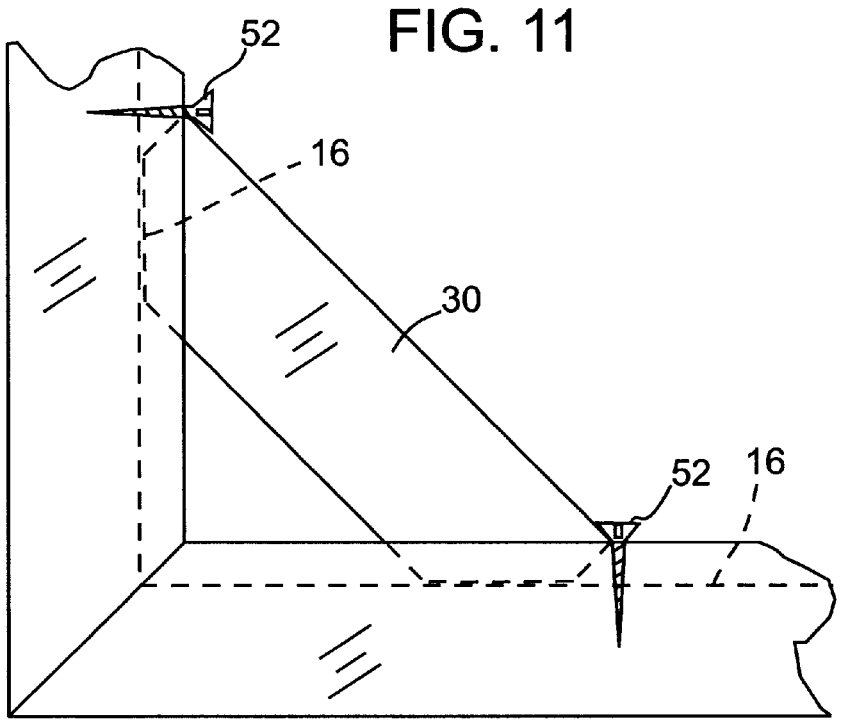
FIG. 11 is a fragmentary view showing a corner of an assembled frame, and showing a diamond brace or angled brace between two right-angle stretcher bars.

FIG. 11 shows another type of angled brace 56 or diamond brace 30, also shown in FIGS. 2P–2T. This illustrates the use of the groove 16 to receive this type of brace. Again, a screw 52 can be used on the stretcher bars at each end of the diamond brace 30, to lock the brace in position. FIG. 7 shows a corner support 55 as used between a brace 24 or 26 and a stretcher bar 12 or 14. The corner support is tenoned as shown at 58, 60 and 62 so that it enters the groove 46 of the brace and the groove 16 of the stretcher bar.

Gluing can be used between internal members of the brace system, but preferably braces are not glued to stretcher bars, since the stretcher bar frame may need to be expanded for re-tensioning of a canvas.

Figure 12:
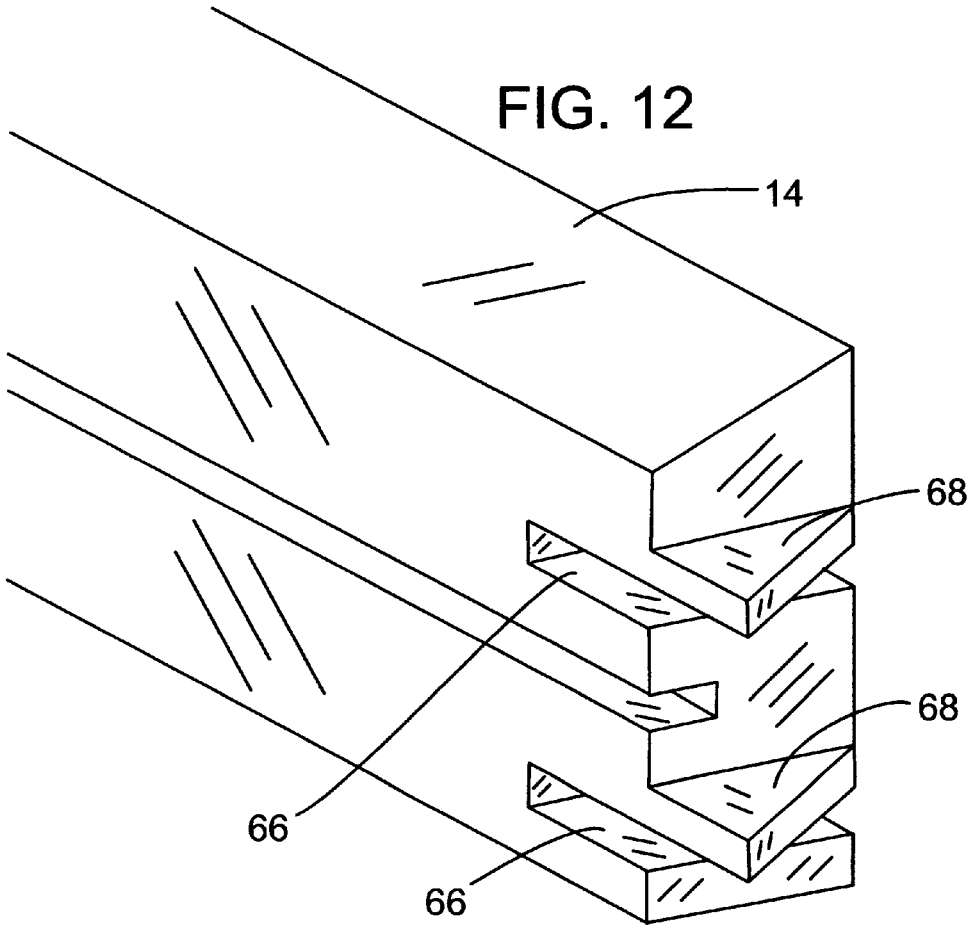
FIG. 12 is a perspective view showing another aspect of the invention, in which stretcher bars have double mortise-and-tenon joints at frame corners.

FIG. 12 shows a portion of a stretcher bar 14, having a double mortise-and-tenon joinery configuration. Typically stretcher bars have a single mortise 66 and a single tenon 68, positioned to be engaged with a complementarily placed tenon-and-mortise in another stretcher bar which is mitered together with the bar 14 at a right angle. In this aspect of the present invention, the end of a stretcher bar 14 has a double mortise and tenon, with an additional tenon 68 and an additional mortise 66 as shown. These cooperate with complementarily placed mortises and tenons on the stretcher bar end to be joined together with the bar 14. These joints typically are not glued but are merely held together by friction, and the doubling of the mortise-and-tenon connection adds further stability and strength to the connection.

Although, as stated above, the braces of the invention, i.e. the simple braces or the cross braces which have at least one end engaging with a stretcher bar, have their tenons 34 at one edge of the brace, these could be centered in the end of the braces if desired, in the same manner as the tenon 44 seen in FIG. 9 or the tenons 49 in FIG. 10. As noted above in the discussion of FIG. 4, the principal reason for the offset of the tenons in the main braces 24 is to accommodate the brace groove 38 which is useful when the frame is expanded for re-tensioning a canvas. However, modularity of the invention can be served by having all braces with the tenons centered. In that case, a different type of expansion wedge can be used between the simple braces and the adjoining stretcher bars, i.e. a forked wedge (not shown) having two wedge sections joined together in a generally U-shape. In this way, the main braces or simple braces described above can be interchangeable with cross braces or middle braces for better modularity in assembling braced frames of various sizes and configurations. In the case of centered tenons on all braces, the groove 16 in the stretcher bars would be moved more toward the center of the width of the bar.

Variations to the preferred embodiments are possible. For example, the braces and/or the stretcher bars could have ridges rather than grooves, with the ends of braces having a groove or mortise to engage with the ridge. The grooves or ridges on the bars or on the braces can be referred to as engagement tracks, and the corresponding engagement structure (tab or groove) on the brace ends can be referred to as cooperative engagement structure.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A modular canvas frame bracing system including a set of parts, comprising:

four stretcher bars assembled into a rectangular frame for supporting a canvas, the stretcher bars each having a groove or ridge running lengthwise in the bar at the inner side of the bar so as to face inwardly in the assembled frame, and a set of brace members of different lengths, each having tabs or groove at ends of the brace member sized to engage with the grooves or ridges of the stretcher bars, whereby the brace members can be selected at appropriate lengths and assembled to extend between parallel stretcher bars to brace the stretcher bars against pulling inward under tension of the canvas.

2. The system of claim 1, wherein the brace members have front and back faces and two sides, the sides having lengthwise grooves or ridges of similar width to the grooves or ridges in the stretcher bars, so that between said brace members installed in one direction in the frame, further brace members of appropriate length can be installed in a perpendicular direction to brace the rectangular frame in the perpendicular direction.

3. The system of claim 1, wherein the stretcher bars have grooves, and further including angled braces with ends and tabs configured to be inserted into the stretcher bar grooves at oblique angles so as to brace corners of the assembled frame.

4. The system of claim 1, wherein the brace members are assembled into the rectangular frame as a simple brace extending from stretcher bar to stretcher bar and a plurality of cross braces each extending between a stretcher bar and a simple brace.

5. The system of claim 1, including at least two simple braces assembled into the rectangular frame to extend from stretcher bar to stretcher bar, and a plurality of cross braces each extending perpendicular to the simple braces, between stretcher and simple braces and between simple braces.

6. The system of claim 5, further including angled braces with ends configured to be engaged with stretcher bars near the intersection of the stretcher bars and to be positioned at oblique angles so as to brace corners of the assembled frame.

7. The system of claim 1, wherein the stretcher bars include grooves in their ends, to accommodate keys or wedges to expand the frame.

8. The system of claim 1, wherein the stretcher bars include double mortise-and-tenon configuration.

9. A canvas frame with bracing, comprising:

four stretcher bars assembled into a rectangular frame for supporting a canvas, the stretcher bars each having an engagement track running lengthwise on the bar at the inner side of the bar so as to face inwardly in the assembled frame, and at least one brace member extending between parallel stretcher bars of the assembled frame, the brace member having a cooperative engagement structure at the ends of the brace member configured to engage with the engagement tracks of the stretcher bars.

10. The canvas frame of claim 9, wherein the brace extending from stretcher bar to stretcher bar is a simple brace, and including a plurality of such simple braces in parallel.

11. The canvas frame of claim 9, wherein the brace extending from stretcher bar to stretcher bar is a simple brace, and including at least two cross braces perpendicular to the simple brace and engaged with stretcher bars and the simple brace to brace the frame in a perpendicular direction.

12. The canvas frame of claim 9, further including a corner brace at each corner, each corner brace having an angled end and engagement structure configured to engage with two of the stretcher bars.

* * * * *